United States Patent [19]

Barrett

[11] Patent Number: 4,932,309

[45] Date of Patent: Jun. 12, 1990

[54] TRIGGER MECHANISM FOR SEMI-AUTOMATIC RIFLE

[76] Inventor: Ronnie G. Barrett, P.O. Box 1077, Murfreesboro, Tenn. 37130

[21] Appl. No.: 339,299

[22] Filed: Apr. 17, 1989

[51] Int. Cl.[5] ..... F41C 19/14

[52] U.S. Cl. ..... 89/145; 42/69.02

[58] Field of Search ..... 42/69.02; 89/141, 145

[56] References Cited

U.S. PATENT DOCUMENTS 4,677,897 7/1987 Barrett ..... 89/166

4,867,040 9/1989 Barrett ..... 89/172

*Primary Examiner*—Stephen C. Bentley

*Attorney, Agent, or Firm*—Harrington A. Lackey

[57] ABSTRACT

A trigger mechanism for a semi-automatic rifle in which a latch-disconnector hook member is mounted on the trigger member for engaging a catch on the transfer bar to temporarily hold the transfer bar down while the trigger is pulled and after the transfer bar has been depressed and thrust rearward by the rearward movement of the cocking lever to ensure the cocking of the firing pin as the bolt carrier moves over the transfer bar.

4 Claims, 1 Drawing Sheet

TRIGGER MECHANISM FOR SEMI-AUTOMATIC RIFLE

BACKGROUND OF THE INVENTION

This invention relates to a trigger mechanism for a semi-automatic rifle, and more particularly to a positive latching-disconnecting mechanism for the transfer bar during he retraction of the bolt carrier.

In the trigger mechanism in a semi-automatic rifle, such as that disclosed in FIGS. 9 and 10 of my prior U.S. Pat. No. 4,677,897, and in my co-pending application Ser. No. 115,821, now U.S. Pat. No. 4,867,040 filed Nov. 2, 1987, for "SELF-UNLOCKING DEVICE FOR RECOILING BOLT CARRIER AND BARREL IN A SEMI-AUTOMATIC RIFLE", the trigger cooperates with a pivotal transfer bar and a vertically reciprocable sear for catching and holding (cocking) the firing pin in a retracted position when the trigger is relaxed and for releasing the firing pin to fire the cartridge, when the trigger is pulled.

After the cartridge is fired and while the bolt carrier is retracting, the cocking lever is pivoted to urge the rear hook on the firing pin beneath the sear hook. As the cocking lever moves rearwardly over the transfer bar, the transfer bar is normally depressed. The sear hook drops and engages the rear hook of the firing pin, in order to cock the firing pin. However, on occasions, and particularly as the cooperating parts of the trigger mechanism become worn, the transfer bar may slip and remain in or return to an upper position. When the bolt carrier returns to its battery position, the sear will be forced upward by the elevated transfer bar to release the firing pin. Since the firing pin is not held in its retracted position, it will continue to repetitively move forward and fire, retract, move forward and fire, as long as the trigger is held in its rearward position. Thus, the semi-automatic rifle becomes a fully automatic rifle when such action is not desired.

SUMMARY OF THE INVENTION

It is therefore an object of this invention to provide in a semi-automatic rifle having a trigger mechanism similar to that described above, a latch-disconnector mechanism for positively holding the transfer bar down while the trigger is in its pulled position and as the bolt carrier, sear and cocking lever move rearwardly over the top of the transfer bar. With the transfer bar held down, the sear hook will always engage and cock the firing pin in its retracted position, and thereby maintain the semi-automatic function of the rifle.

More specifically, a latch-disconnector hook is attached to the upper portion of the trigger member so that when the trigger is pulled, the hook will move forward. Then, as the transfer bar is pushed downward and thrust rearward by the rearward movement of the cocking lever as the bolt carrier retracts, a catch ledge formed on the transfer bar is moved below and beneath the latch-disconnector hook for cooperative engagement between the two in order to hold the transfer bar down as long as the trigger is pulled rearward. This action permits the sear to drop causing the sear hook to engage the rear hook on the firing pin to hold the firing pin in its retracted position until the bolt carrier has again been moved forward to its battery position and the trigger actuated to release the firing pin and fire the cartridge.

DESCRIPTION OF THE PREFERRED EMBODIMENT

Figure 1:
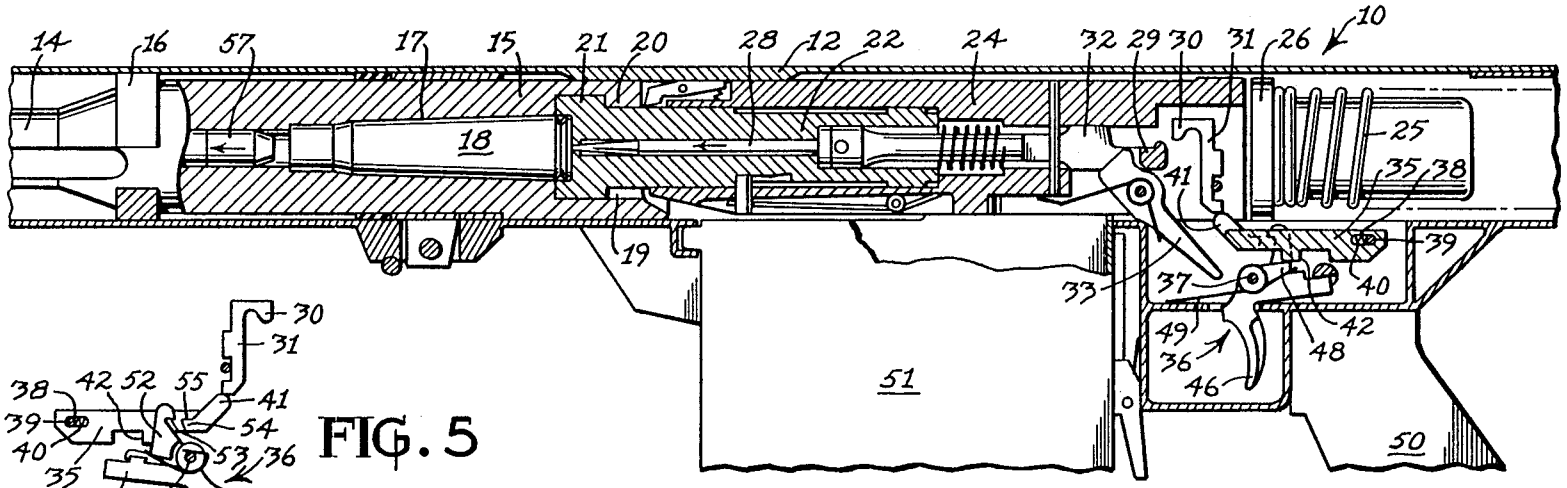
FIG. 1 is a fragmentary elevational view of the middle portion of a semi-automatic rifle, made in accordance with this invention, with portions disclosed in section, and disclosing the rifle in a firing position, with the trigger pulled rearward.

Referring now to the drawings in more detail, FIG. 1 discloses a semi-automatic rifle 10 made in accordance with this invention, including an elongated housing 12.

An elongated barrel 14 is slidably received within the housing 12 for longitudinal reciprocable movement. The enlarged cylindrical rear end portion or extension of the barrel 15 (FIG. 1) is slidably received within a rear bushing or annular stop member 16.

The barrel 14 is normally biased forward by barrel springs, not shown, in a manner similar to that disclosed in my prior pending application Ser. No. 115,821, now U.S. Pat. No. 4,867,040.

The enlarged rear end portion or rear barrel extension 15 contains a barrel chamber 17 for receiving a cartridge 18.

The barrel extension 15 includes a rear locking chamber 19 and a plurality of circumferentially spaced radially inward directed barrel locking lugs 20. The barrel locking lugs 20 are adapted to cooperate with a plurality of circumferentially spaced radially outward projecting bolt locking lugs 21 formed on the front end portion of the bolt 22 which is reciprocably carried within a bolt carrier 24. The bolt carrier 24 is adapted to move reciprocably and longitudinally within the housing 12 and between the barrel extension 15 and the front end of the recoil spring 25 provided with a front buffer pad or member 26 for engaging the rear end of the bolt carrier 24.

An elongated firing pin assembly 28 is reciprocably mounted longitudinally and coaxially within the center of the bolt 22, in a conventional manner. The rear end portion of the firing pin assembly 28 includes a firing pin hook 29 adapted to cooperate with the sear hook 30 of a vertically reciprocable sear 31 in a conventional manner.

A vertical slot 32 in the rear portion of the firing pin assembly 28 is adapted to receive a pivotal cocking lever 33.

A coil spring, not shown, within the firing pin assembly 28 within the bolt carrier 24 normally urges the firing pin forward.

The sear 31 is adapted to be raised to disengage the rear hook 29 of the firing pin 28 from the sear hook 30 when the elongated transfer bar 35 is raised or lifted by the trigger member 36 when pivoting in a counter-clockwise direction about the transverse trigger pivot pin 37.

Figure 3:
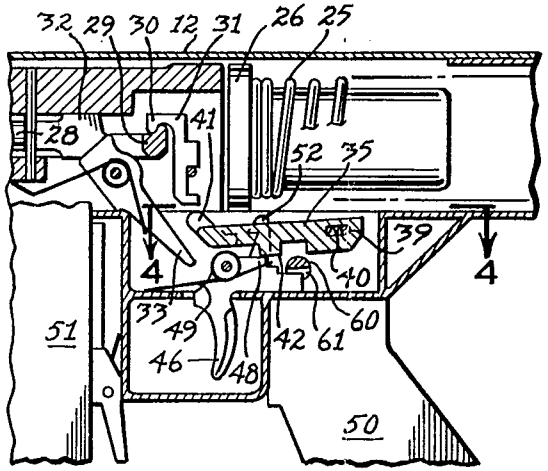
FIG. 3 is a fragmentary elevational view similar to FIG. 2 in which the trigger is released, and the bolt carrier, together with the cocked firing pin is in its forward battery motion.

The transfer bar 35 is provided in its rear end portion with an elongated transverse slot 38 receiving a transfer pivot pin 39. The length of the transverse slot 38 may be 2 to 3 times as great as the diameter of the pivot pin 39. Moreover, the transfer bar 35 is normally urged forward relative to the pivot pin 39 by one or more spring members 40, (FIGS. 1 and 3).

The front end portion of the transfer bar 35 is provided with a pair of slightly upward projecting transversely spaced ears or lifter cams 41 for engaging the bottom of the sear 31, to enable the sear 31 to be lifted when the transfer bar 35 is pivoted upward about the pivot pin 39.

Formed on the bottom surface of the transfer bar 35 is a downward projecting lug or land 42.

The trigger member 36 includes a mounting body 44 through which is journaled the trigger pin 37 and which extends through the opposed walls of the trigger housing 45. The trigger housing 45 forms a part of the rifle housing 12, but depends below the bolt carrier 24.

Fixed to and depending from the mounting body 44 is the trigger 46. Projecting rearwardly from the mounting body 44 is the trigger lever 47. Projecting upward from and fixed to either the mounting body 44 or the trigger lever 47 is a lifting lug or trigger cam 48, which registers with the depending transfer bar lug or land 42 when the transfer bar 35 is in its forward position, such as illustrated in FIGS. 1 and 3. The trigger 46 is normally biased forward to its inoperative position by the coiled trigger spring 49.

The features thus far described are old in the art, as described in Applicant's co-pending application Ser. No. 115,821, now U.S. Pat. No. 4,867,040 filed Nov. 2, 1987.

A pistol grip stock 50 is fixed upon the rifle housing immediately behind the trigger 46, in a conventional manner. Mounted in front of the trigger 46 is a conventional magazine 51 for feeding cartridges to the bolt 22.

In order to prevent the transfer bar 35 from remaining in its upper pivotal position while the trigger 46 is pulled rearwardly and the bolt carrier 24 is retracting, a latching-disconnector mechanism is provided for normally holding the trigger member 36 and the transfer bar 35 together in the lower position of the transfer bar 35 when the trigger 46 is in its rearward position.

This latch-disconnector mechanism is preferably provided in the form of an upstanding hook or hook member 52 pivotally mounted upon and projecting upward from the mounting body 44. The hook member 52 is preferably provided with a forward projecting bill 53 which is adapted to fit over a rearward projecting catch member or ledge 54 having an upward directed face or top surface 55. This catch member 54 is formed in the front end portion of the transfer bar 35. The hook member 52 is preferably mounted for pivotal movement upon the trigger pivot pin 37, and is biased to its forward position by a spring, not shown.

Figure 4:
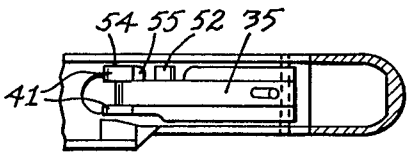
FIG. 4 is an enlarged fragmentary plan sectional view of a portion of the trigger mechanism, taken along the line 4—4 of FIG. 3.
Figure 5:
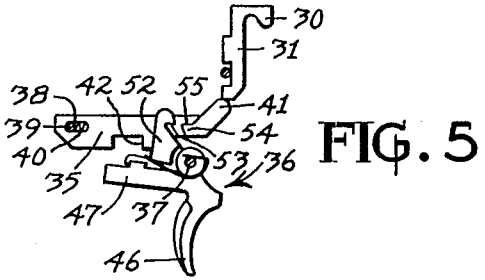
FIG. 5 is an elevational view taken from the opposite side of FIG. 3, and disclosing only the trigger member, the transfer bar, and the sear.

As best disclosed in FIGS. 3, 4, and 5, when the trigger 46 is not actuated and in its inoperative forward position, the latch hook or hook member 52 will lie behind the catch member 54, and therefore there will be no engagement of the hook member 52 with the catch member 54 regardless of the pivotal position of the transfer bar 35.

Figure 2:
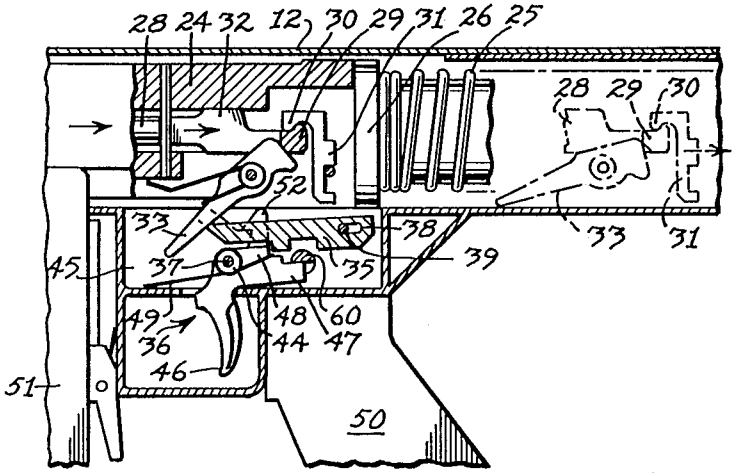
FIG. 2 is a fragmentary elevational view of the trigger mechanism portion of the rifle disclosed in FIG. 1, in which the bolt carrier is retracting, the trigger is still in a rearward position, but the firing pin is cocked and the transfer bar latched in a down position, and further illustrating the cocked firing pin in phantom in a further rearward position.

When it is desired to fire the rifle 10, the trigger 46 is squeezed and pulled rearwardly causing the trigger member 36 to rotate in a counter-clockwise direction about the trigger pivot pin 37, as illustrated in FIGS. 1 and 2. After the trigger 46 is pulled, the trigger cam 48 is elevated to engage the depending lug 42 and lift the transfer bar 35. When the bolt carrier 24 is forward in its battery position, the rising transfer bar 35 will cause the cam lugs 41 to engage the bottom of the sear 31 thereby lifting the sear 31 and causing the sear hook 30 to rise above and disengage the rear hook 29 of the firing pin 28. The firing pin 28 will immediately be released to rapidly move forward under the action of the firing pin spring to cause the firing pin 28 to detonate the cartridge 18 in order to fire a bullet or projectile 57 through the barrel 14, as illustrated in FIG. 1.

During the firing operation, although the latch-disconnector hook 52 will move forward, nevertheless, because the transfer bar 35 is rising, the latch-disconnector hook 52 will move beneath the catch member 54 so that there will be no engagement of the latch-disconnector hook 52 with the catch member 54 during the firing operation.

However, after the firing operation, the explosion within the cartridge 18 causes the bolt carrier 24 to rapidly recoil and retract against the action of the recoil spring 25. As best illustrated in FIG. 2, as the bolt carrier 24 is retracting the cocking lever 33 is rotated in a clockwise direction causing the rear hook 29 of the firing pin 28 to move rearward beneath the sear hook 30. Moreover, the cocking lever 33, since it depends below the bolt carrier 24, engages the transfer bar 35 normally depressing the transfer bar 35 in a lower position, and also forcing the transfer bar 35 rearward against the action of the transfer bar spring 40 causing a slight rearward movement of the transfer bar 35 relative to the transfer pivot pin 39, as illustrated in FIG. 2. When this compound motion occurs, the catch member 54 forces the latch-disconnector hook 52 pivotally rearward against the action of its own spring, not shown, causing the top surface 55 to slip beneath the bill 53 of the latch-disconnector hook 52, causing the transfer bar 35 to be latched in its lower position against the trigger mechanism 36, as illustrated in FIG. 2.

This latching action assures that the sear 31 is free from contact with the transfer bar 35 when the bolt carrier 24 returns to battery, so that there will be no additional firing action until the trigger 46 is pulled again.

It should be noted in FIG. 2, that the latching action between the latch-disconnector hook 52 and the catch member 54 can only occur while the trigger 46 is pulled rearward. When the trigger 46 is released to its forward position, as illustrated in FIG. 3, the latch-disconnector hook 52 is moved rearward and downward away from engagement with the ledge or catch member 54 to release the transfer bar 35, which is now in its lower position and in readiness for the next firing operation.

The movement of the bolt carrier 24 is so fast that the operator may still have his finger on the trigger 46 as the bolt carrier 24 and the sear 31 move rearwardly past the trigger mechanism. Thus, if the cocking lever 33 is not performing its function or there are parts which are not catching or the transfer bar 35 remains in its upper position, while the trigger 46 is in its rearward position, the firing pin rear hook 29 will not be caught because the sear 31 is still in its elevated position and the firing operation will automatically be repeated without any further trigger actuation. Thus, an inadvertent automatic firing will result instead of the desired semi-automatic function.

However, the latching mechanism including the latch-disconnector hook 52 and the catch member 54 obviate this inadvertent hanging or suspension of the transfer bar 35 in its elevated position as the cocking lever 33 and the bolt carrier 24 move over the transfer bar 35.

The rear trigger lever 47 is shown in the drawings as cooperating with a rotary elongated safety member or spindle 60, which includes a notch 61. As illustrated in the drawings, the notch 61 is in its firing position so that the trigger member 46 is free to pivot and perform its normal firing function. The safety spindle 60 and the cooperating trigger lever 47 are well known in the art, as illustrated in FIGS. 9 and 10 of my prior U.S. Pat. No. 4,677,897.

What is claimed is:

1. In a semi-automatic rifle having an elongated housing including a reciprocable bolt carrier, a bolt within the bolt carrier, a firing pin within the bolt having a rear hook, a vertically reciprocable sear within the bolt carrier and having a sear hook adapted to engage the rear hook when the firing pin is in a rear cocking position, and a cocking lever pivotally mounted within and depending from the bolt carrier and cooperative with the rear hook for cocking the firing pin, a trigger mechanism comprising:

(a) a trigger member comprising a mounting body and a trigger depending from said mounting body, (b) a trigger pivot pin supporting said mounting body on said housing below said bolt carrier for pivotal movement of said trigger member about an axis transverse to said elongated housing, and a trigger spring biasing said trigger forward, (c) an elongated transfer bar having a rear end portion and a front end portion, (d) a transfer pivot pin mounting said rear end portion of said transfer bar in said housing in the longitudinal path of said cocking lever for pivotal movement about a transverse axis above said trigger member and limited longitudinal movement relative to said transfer pivot pin, (e) transfer spring means biasing said transfer bar forward relative to said transfer pin, (f) sear lifter means on the front end portion of said transfer bar for engaging and lifting said sear, (g) cooperative means on said trigger member and said transfer bar for lifting said transfer bar when said trigger is pulled rearward, (h) a catch member on said front portion of said transfer bar, and (i) a latch-disconnector hook member projecting upward from said mounting body and having a projecting hook adapted to engage said catch member to hold said transfer bar down in a caught position only when said trigger has been pulled rearward and said transfer bar has been thrust downward and rearward by said cocking lever.

2. The invention according to claim 1 in which said catch member comprises a ledge having a top surface projecting rearward, said hook having a forward projecting bill adapted to fit over and engage said top surface of said ledge in said caught position.

3. The invention according to claim 2 in which said cooperative means comprises a lift cam projecting upward from said trigger member and a lug projecting downward from said transfer bar engaging said lift cam.

4. The invention according to claim 2 in which said hook is adapted to move forward, beneath and disengaged from said ledge when said transfer bar is in its forward position and lifted upward by said trigger member.

* * * * *